US007162822B1

(12) United States Patent
Heayn et al.

(10) Patent No.: US 7,162,822 B1
(45) Date of Patent: Jan. 16, 2007

(54) COLLAPSIBLE BUTTSTOCK FOR FIREARM

(75) Inventors: Michael Heayn, Wharton, NJ (US); Christopher M. Shaffer, NE Hartville, OH (US); Dean M. Mohamed, Caldwell, NJ (US); Kenneth R. Jones, Wayne, NJ (US); Richard Beckman, Randolph, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 9 days.

(21) Appl. No.: 11/160,368

(22) Filed: Sep. 19, 2005

Related U.S. Application Data

(60) Provisional application No. 60/593,272, filed on Jan. 3, 2005.

(51) Int. Cl.
*F41C 23/04* (2006.01)
*F41C 23/14* (2006.01)

(52) U.S. Cl. ..... 42/73; 42/71.01

(58) Field of Classification Search ..... 42/71.01–73
See application file for complete search history.

(56) References Cited

U.S. PATENT DOCUMENTS 5,031,348 A * 7/1991 Carey ..... 42/74
5,173,564 A * 12/1992 Hammond, Jr. ..... 42/75.03
5,392,553 A * 2/1995 Carey ..... 42/73
5,726,377 A * 3/1998 Harris et al. ..... 89/191.01
5,827,992 A * 10/1998 Harris et al. ..... 89/191.01
6,517,133 B1 * 2/2003 Seegmiller et al. ..... 294/139
6,553,707 B1 * 4/2003 Tseng ..... 42/72
6,560,911 B1 * 5/2003 Sharp ..... 42/73
6,651,371 B1 * 11/2003 Fitzpatrick et al. ..... 42/72
6,662,485 B1 * 12/2003 Kay ..... 42/75.03
6,779,289 B1 * 8/2004 Kay ..... 42/75.03
6,901,691 B1 * 6/2005 Little ..... 42/118
6,925,744 B1 * 8/2005 Kincel ..... 42/71.01

* cited by examiner

*Primary Examiner*—Michael J. Carone
*Assistant Examiner*—Bret Hayes
(74) *Attorney, Agent, or Firm*—Michael C. Sachs; John F. Moran

(57) ABSTRACT

A buttstock for a firearm having a buffer recoil mechanism is collapsible and adjustable. The buttstock includes a lower receiver extension having a bore therein that fits over the buffer recoil mechanism, the lower receiver extension being fixed to the buffer recoil mechanism; a buttstock body having a bore therein for receiving the lower receiver extension; a locking lever disposed along the bottom edge of the buttstock body; a locking pin disposed in the buttstock body and in the locking lever; and a compression spring disposed around the locking pin for biasing the locking pin towards the lower receiver extension.

21 Claims, 8 Drawing Sheets

COLLAPSIBLE BUTTSTOCK FOR FIREARM

CROSS-REFERENCE TO RELATED APPLICATIONS

This application claims the benefit under 35 USC 119(e) of U.S. provisional patent application 60/593,272 filed on Jan. 3, 2005, the entire file wrapper contents of which application are herein incorporated by reference as though fully set forth at length.

FEDERAL INTEREST STATEMENT

The inventions described herein may be made, used, and licensed by or for the U.S. Government for U.S. Government purposes.

BACKGROUND OF THE INVENTION

The present invention relates in general to firearms and in particular to collapsible buttstocks for firearms.

Collapsible buttstocks for firearms, such as the U.S. Army's M249 Squad Automatic Weapon (also known by other names in other military branches), are known. However, there are some problems with the known buttstocks. For example, existing buttstocks only allow the user to comfortably fire the machine gun when the buttstock is in the extended position. When the existing buttstock is in the fully collapsed position, the shoulder plate is in a horizontal orientation. Although it is possible, it is very uncomfortable for the user to fire the machine gun when the shoulder plate is in a horizontal orientation. The horizontal orientation of the shoulder plate does not provide a secure shoulder to weapon interface. Thus, the accuracy and control of the weapon is decreased.

Another limitation of the existing collapsible buttstock is that the only two possible firing positions are with the buttstock fully extended or with the buttstock fully collapsed. As noted above, it is very uncomfortable to fire the machine gun with the buttstock fully collapsed. In addition, the existing buttstock does not provide any firing positions intermediate the fully extended or fully collapsed positions.

The limitations of the known buttstock have become more apparent because of the increased use of firearms in military operations in urban terrain (MOUT). When a weapon is used in MOUT, the user often desires to fire the weapon with the stock fully or partially collapsed. In addition, the user is often wearing body armor that protrudes from the shoulder area, thus requiring a shorter or adjustable stock.

SUMMARY OF THE INVENTION

It is an object of the invention to provide a collapsible buttstock for a firearm such that the firearm may be comfortably fired with the buttstock in either the fully extended or fully collapsed position.

It is another object of the invention to provide a collapsible, adjustable buttstock for a firearm such that the firearm may be fired with the buttstock in positions intermediate the fully extended and fully collapsed position. The plurality of firing positions of the buttstock provides greater lethality and increased survivability for the user.

A further object of the invention is to provide a collapsible, adjustable buttstock wherein the shoulder plate remains in a vertical position at all times.

In one embodiment, a buttstock in accordance with the invention is used with a firearm having a buffer recoil mechanism. The buttstock comprises a lower receiver extension having a bore therein that fits over the buffer recoil mechanism. The lower receiver extension is fixed to the buffer recoil mechanism. The buttstock further comprises a buttstock body with a bore therein for receiving the lower receiver extension, a cheek rest located above the bore, a generally planar rear surface and a bottom edge.

The buttstock body and lower receiver extension are axially movable with respect to each other by movement of the lower receiver extension in the bore of the buttstock body. The buttstock body includes a generally vertical through-hole. A locking lever is disposed along the bottom edge of the buttstock body. The locking lever includes a hole therein in alignment with the through-hole in the buttstock body. A locking pin is disposed in the through-hole in the buttstock body and in the hole in the locking lever. A compression spring is disposed around the locking pin for biasing the locking pin towards the lower receiver extension.

In one embodiment, a bottom portion of the lower receiver extension includes a plurality of detents and the locking pin has a head sized to fit in the plurality of detents in the lower receiver extension. This embodiment provides a discrete plurality of adjustment positions for the length of the collapsible buttstock.

In another embodiment, friction between the head of the locking pin and the bottom portion of the lower receiver extension provides the locking mechanism. In this embodiment, the collapsible buttstock is infinitely adjustable along the length of the lower receiver extension.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
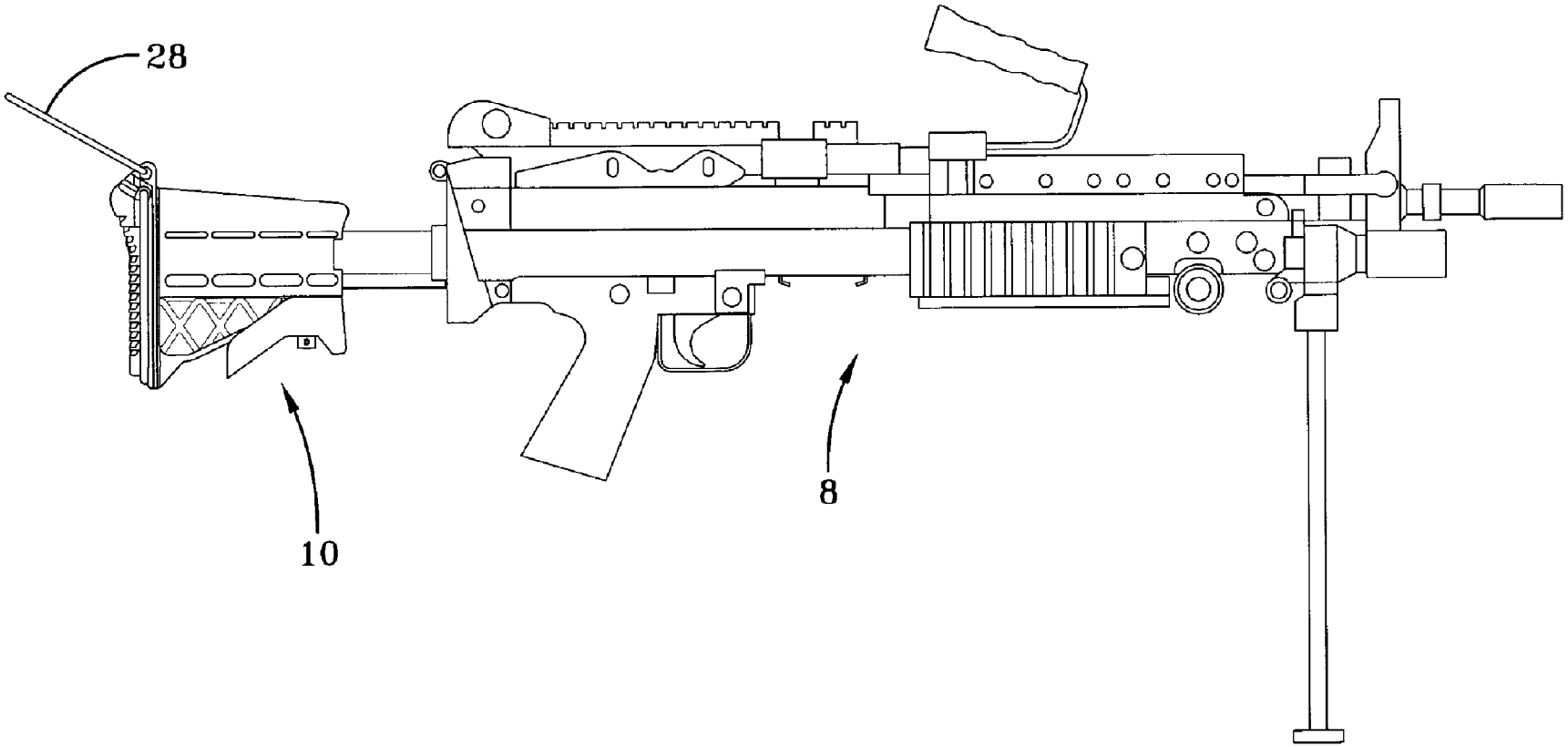
FIG. 1 shows a firearm with a buttstock.

FIG. 1 shows a firearm 8 including a buttstock 10. Firearm 8 shown in FIG. 1 represents an M249 machine gun, but could be any firearm fitted with an adjustable, collapsible buttstock. In FIG. 1, the buttstock 10 is shown in the fully extended position with the shoulder rest 28 in the up position. Firearm 8 includes a buffer recoil mechanism 14 (FIG. 2B). Buffer recoil mechanism 14 is mounted to firearm 8 via bosses 44 on backplate 40. A rod 46 connects to a piston (not shown) inside of cylindrical portion 42. Cylindrical portion 42 is filled with a fluid, such as oil. Rod 46 receives recoil from the firearm 8, which is dampened by the piston acting on the oil.

Figure 2A:
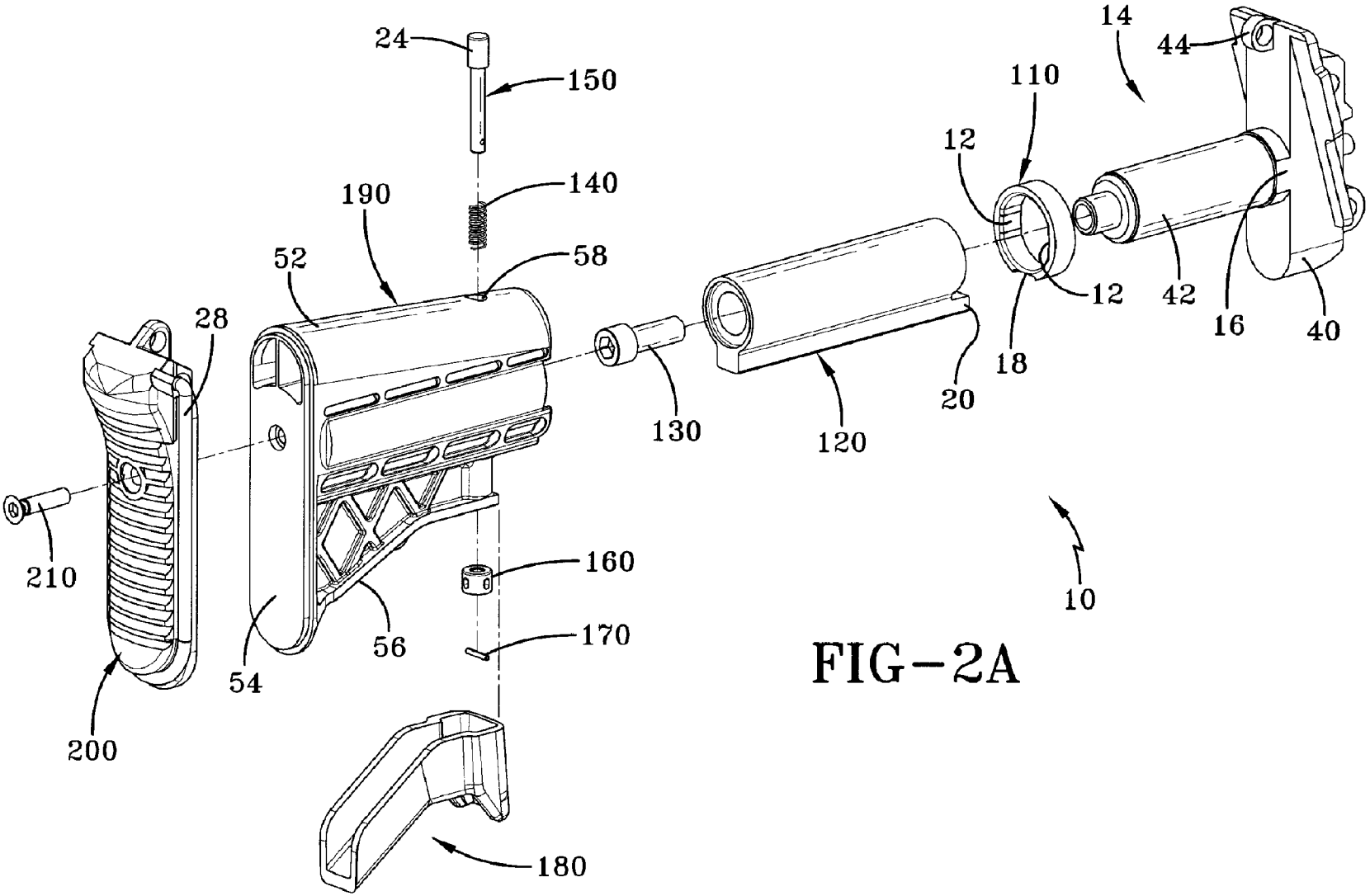
FIG. 2A is a perspective, exploded view of one embodiment of a buttstock.
Figure 2B:
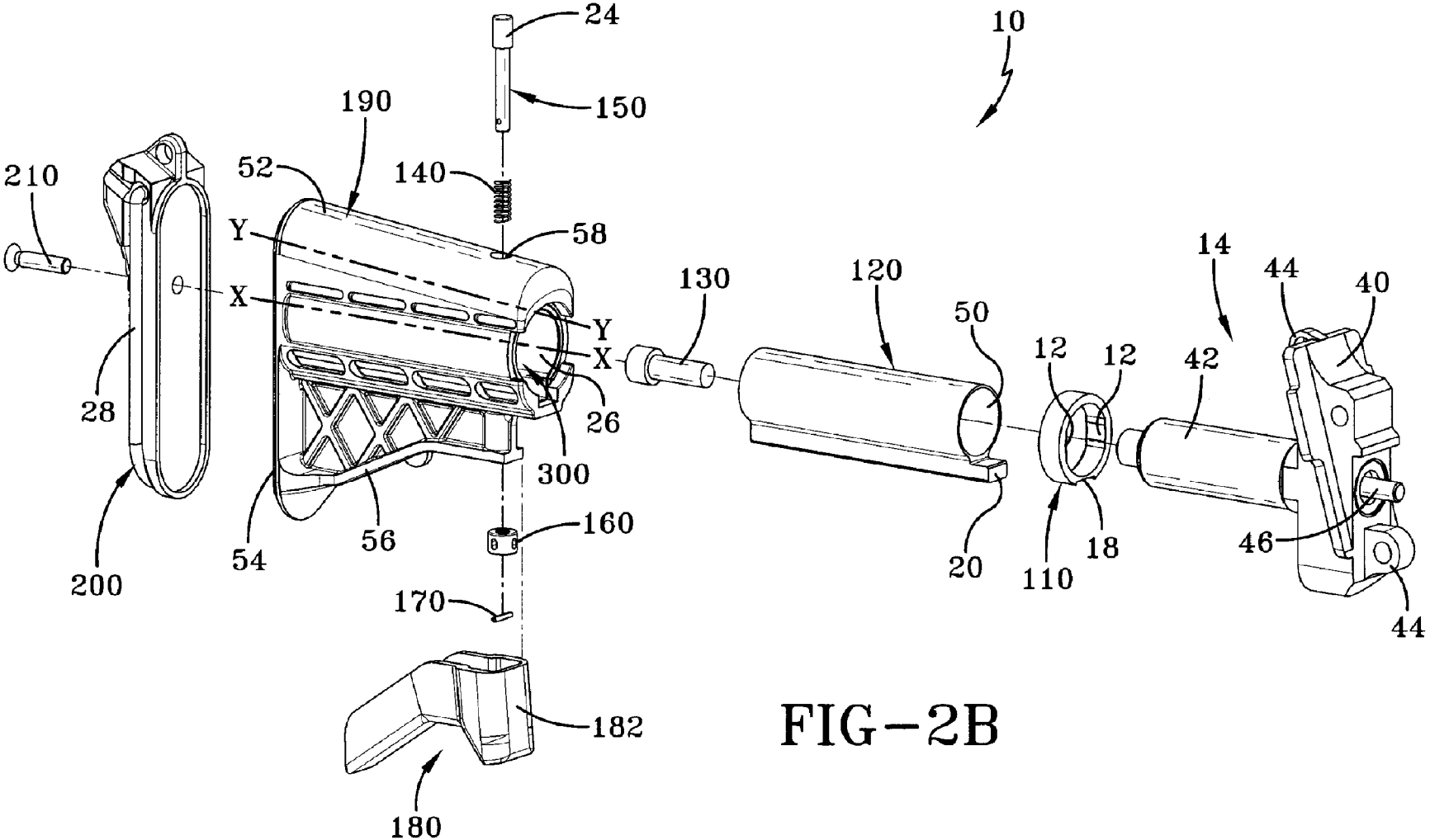
FIG. 2B is a perspective, exploded view of the buttstock of FIG. 2A, viewed from a different angle.
Figure 3A:
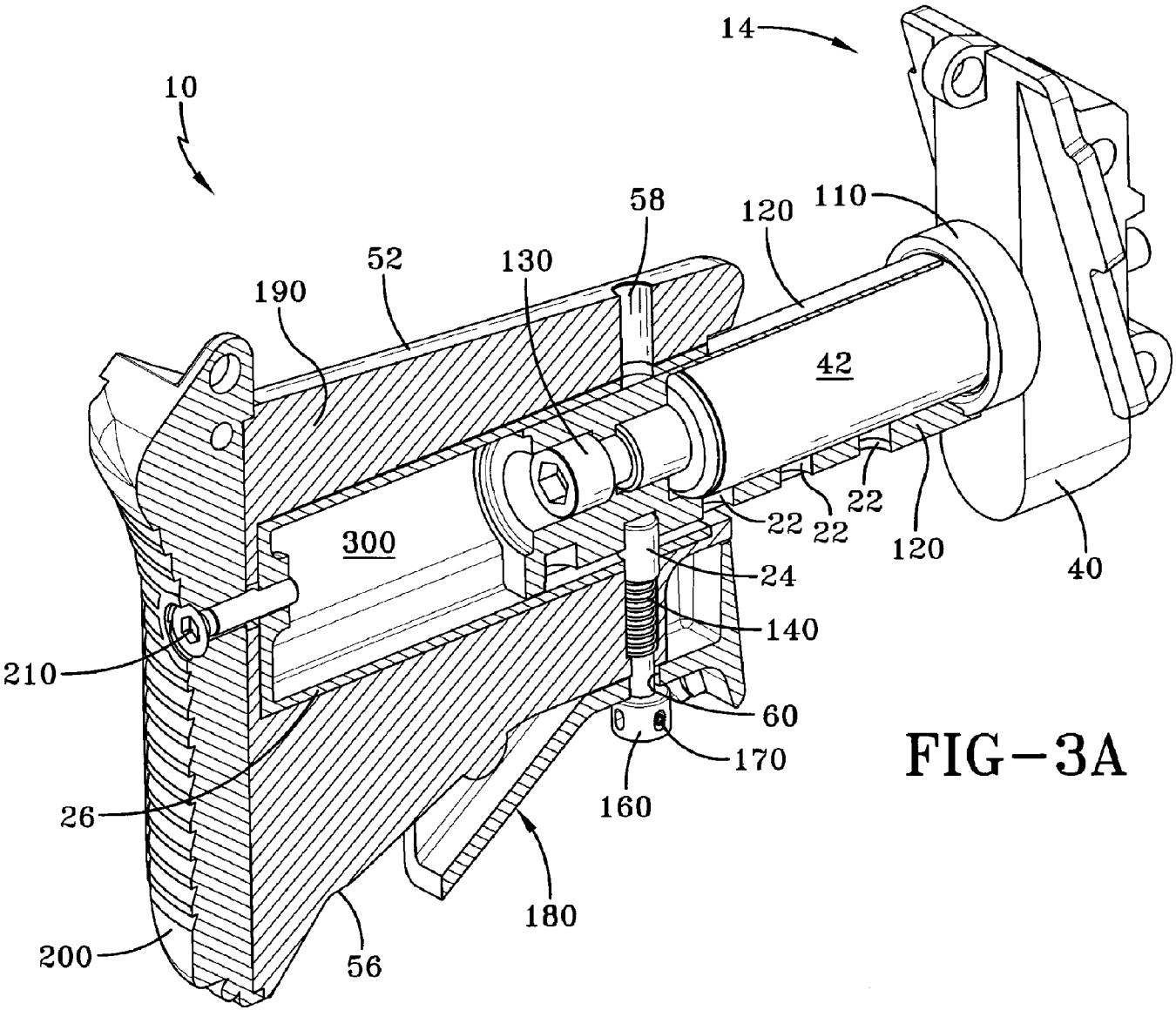
FIGS. 3A and 3B are perspective, cutaway views of the buttstock of FIG. 2A.
Figure 3B:
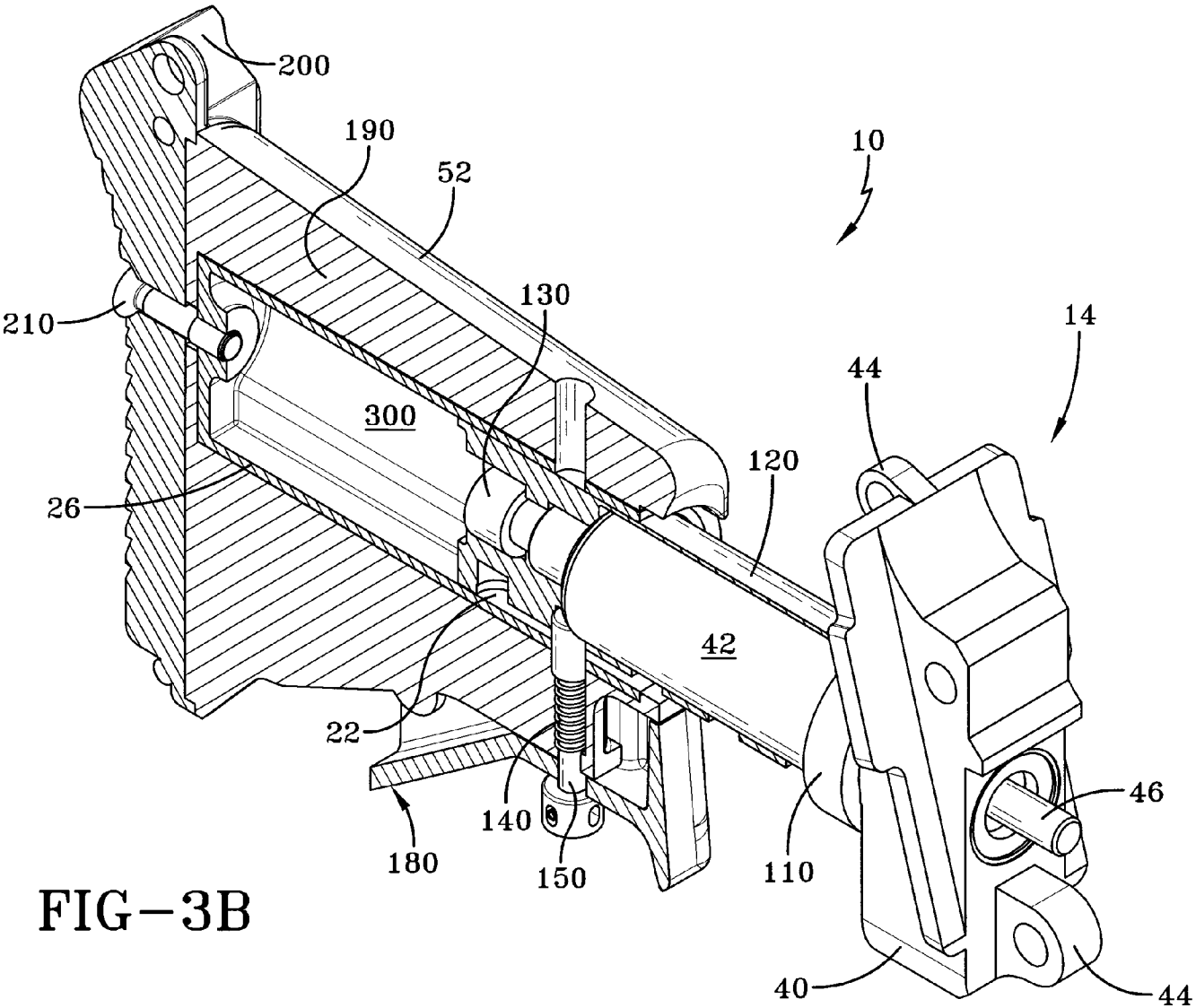
Figure 4A:
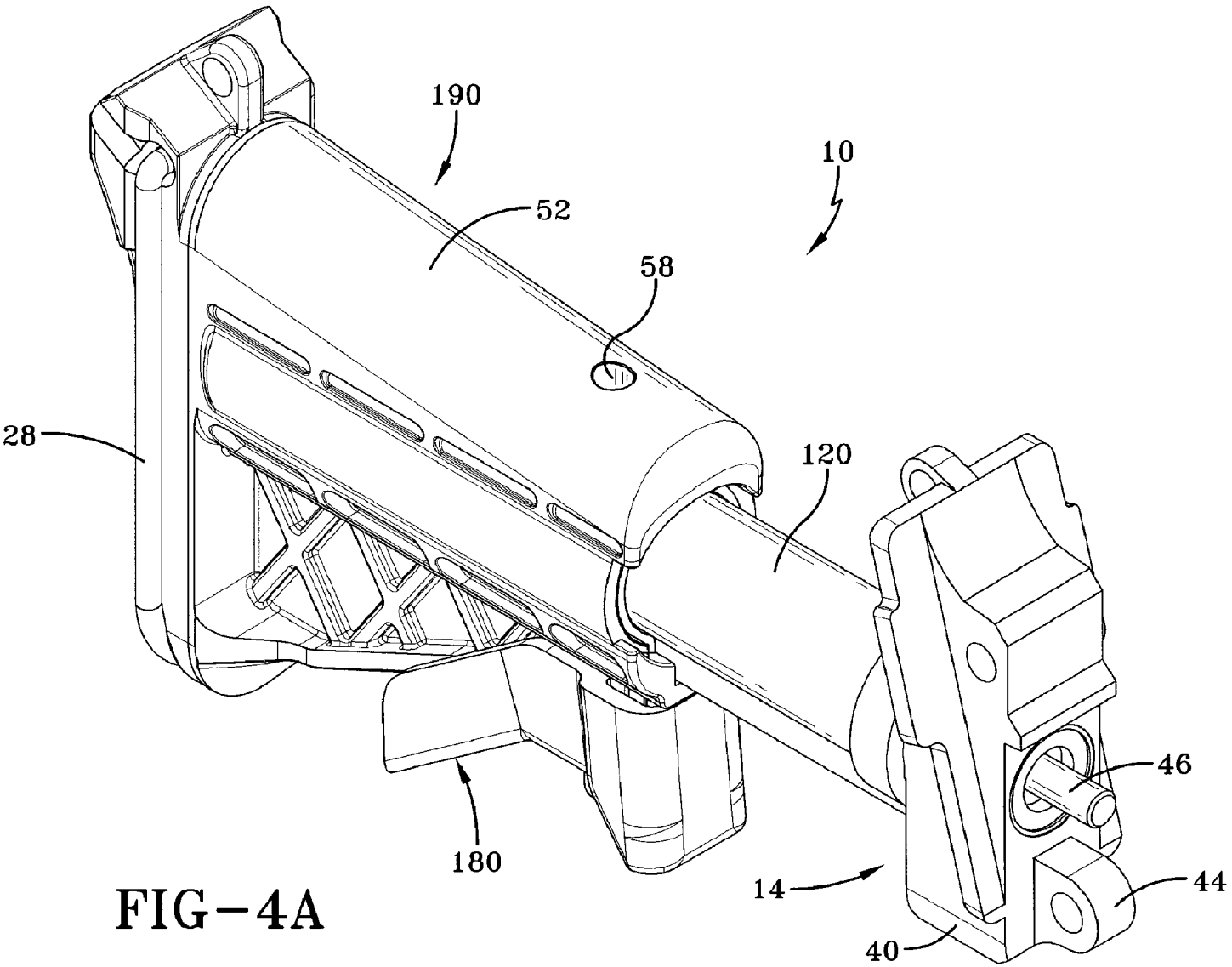
FIGS. 4A and 4B are perspective views of the buttstock of FIG. 2A.
Figure 4B:
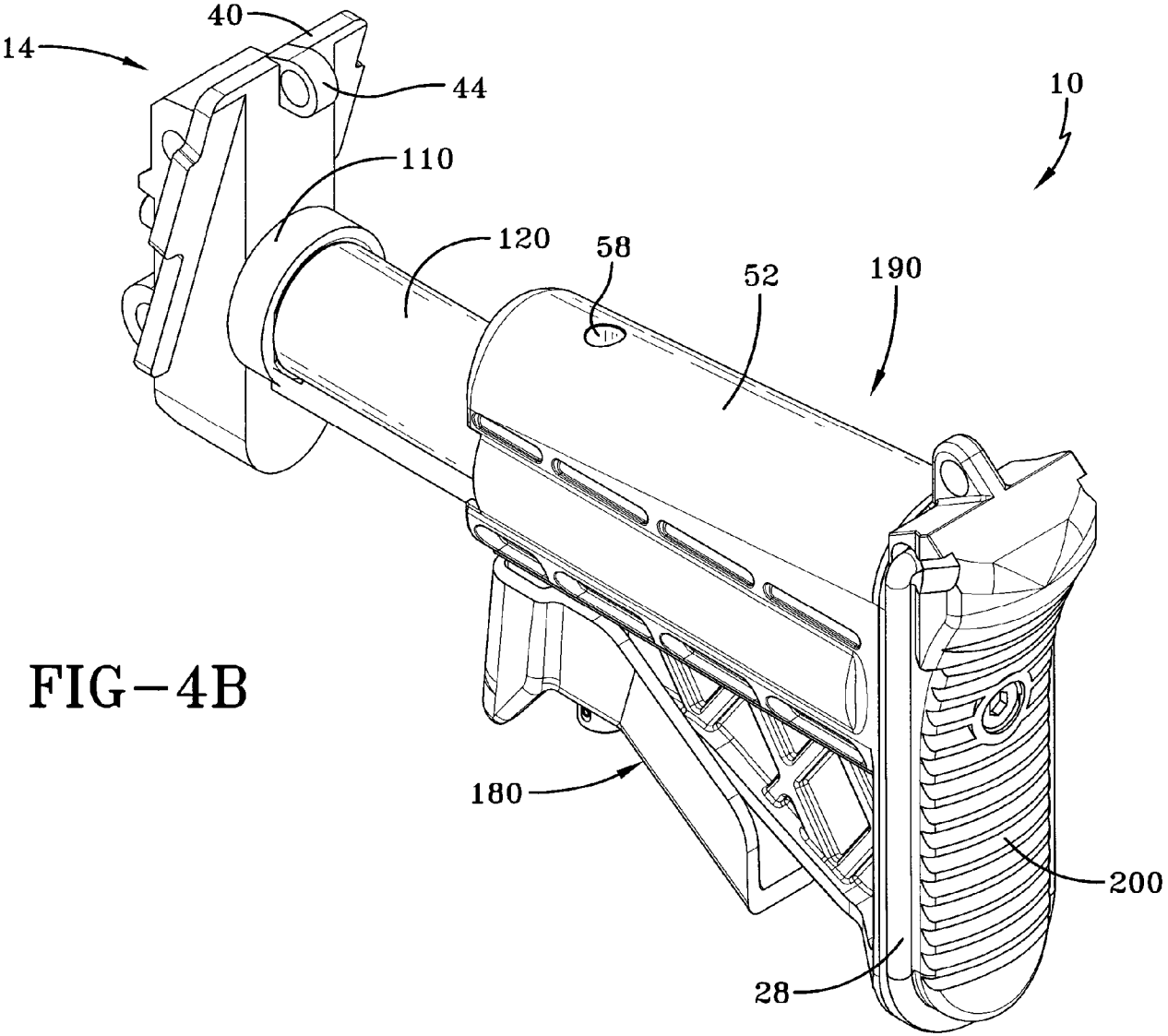

Referring now to FIGS. 2–4, one embodiment of the buttstock 10 comprises a lower receiver extension 120 having a bore 50 therein that fits over the cylindrical portion 42 of the buffer recoil mechanism 14. The lower receiver extension 120 is fixed to the buffer recoil mechanism 14 with a locking collar 110 and fastener 130. The fastener 130 (for example, a socket head cap screw) with a thread locking element, such as a LOCTITE patch, is inserted through the backside of the lower receiver extension 120 and threads into the rear of the cylindrical portion 42 of the buffer recoil mechanism 14.

In the embodiment of FIGS. 2–4, the bottom portion of the lower receiver extension 120 includes a plurality of openings or detents 22 (FIG. 3A). The head 24 of locking pin 150 fits in detents 22 to control the length of the buttstock 10. In one embodiment, the number of detents 22 is five, thereby allowing the length of the buttstock 10 to be adjusted to five different positions. However, the number of detents 22 may be more or less than five. The plurality of detents 22 provide a discrete plurality of adjustment positions for the length of the collapsible buttstock 10.

The buttstock body 190 includes a bore 300 for receiving the lower receiver extension 120. The buttstock body 190 and lower receiver extension 120 are axially movable with respect to each other by movement of the lower receiver extension 120 in the bore 300. Buttstock body 190 also includes a generally vertical through-hole 58.

Buttstock body 190 may be made of, for example, metal or plastic or a combination thereof. In one embodiment of the invention, the buttstock body 190 is molded around a generally hollow insert 26 (FIG. 2B) that is closed at one end. The insert 26 may be made of a metal, such as steel, aluminum or titanium. The insert 26 adds strength and durability to the buttstock 10. Alternate modes of construction include, for example, sliding, snapping, gluing melting or screwing together the insert 26 and body 190. Of course, it is not necessary to use insert 26 at all. Bore 300 may be formed directly in body 190.

Buttstock body 190 further includes a cheek rest 52 located above the bore 300, a generally planar rear surface 54 and a bottom edge 56. As shown in FIG. 2B, an axis Y—Y of cheek rest 52 is inclined with respect to an axis X—X of the bore 300. The cheek rest 52 rises in a direction toward the buttplate 200. The angled cheek rest 52 has been found to be better suited to the user than a straight cheek rest.

A locking lever 180 is disposed along the bottom edge 56 of the buttstock body 190. The locking lever 180 includes a hole 60 (FIG. 3A) therein in alignment with the through-hole 58 in the buttstock body 190. The locking lever 180 is an ergonomically contoured lever that allows the length of the buttstock 10 to be adjusted. The shape of the locking lever 180 makes shouldering the firearm 8 more comfortable for the user. The locking lever 180 includes a rounded front surface 182 that provides a comfortable position for the gunner to hold the buttstock and pull it into his/her shoulder to steady the weapon and increase control.

A locking pin 150 is disposed in the through-hole 58 in the buttstock body 190 and in the hole 60 in the locking lever 150. The locking pin 150 has a head 24 sized to fit in the plurality of detents 22 in the lower receiver extension 120. A fastener is attached to the bottom of the locking pin 150. The fastener may be, for example, a locking nut 160 and roll pin 170. The locking nut 160 screws onto the locking pin 150 and holds it in place. The roll pin 170 fixes the locking nut 160 onto the locking pin 150.

A compression spring 140 is disposed around the locking pin 150 for biasing the locking pin 150 towards the lower receiver extension 120. The spring 140 is confined within the buttstock body 190 and allows the head 24 of the pin 150 to always have positive pressure in the upward direction so it will move into one of the detents 22 on the underside of the lower receiver extension 120. The locking pin 150 is secured within the buttstock body 190. The pin 150 is attached to the locking lever 180 and is spring loaded by spring 140. When the locking lever 180 is squeezed, the head 24 of the pin 150 moves down and allows the length of the buttstock 10 to be adjusted in or out. When the locking lever 180 is released, the head 24 of the pin 150 will fall into the nearest detent 22 on the lower receiver extension 120. This will lock the length of the buttstock 10.

A buttplate 200 is attached to the generally planar rear surface 54 of the buttstock body 190. The buttplate 200 may be made of a rigid material such as a metal or a rigid plastic or, in other embodiments, an elastic material, such as rubber. A foldable shoulder rest 28 is attached to buttplate 200. Shoulder rest 28 is generally U-shaped and formed of a rigid material. The buttplate 200 strengthens the buttstock 10 and provides a comfortable shoulder to weapon interface. The fastener 210, such as a screw, fixes the buttplate 200 to the buttstock body 190. The fastener 210 has a patch of a thread-locking element, such as a LOCTITE patch, on it.

Locking collar 110 engages the cylindrical portion 42 of the buffer recoil mechanism 14 and the lower receiver extension 120 to prevent rotation of the lower receiver extension 120 relative to the buffer recoil mechanism 14. The locking collar 110 includes a pair of flats 12 formed on an interior surface thereof that mate with a pair of flats 16 on an exterior surface of the cylindrical portion 42. Flats 12, 16 prevent the locking collar 110 from rotating with respect to the cylindrical portion 42. Locking collar 110 also includes a flat 18 formed on an exterior surface thereof that mates with a flat 20 on the lower receiver extension 120. Flats 18, 20 prevent the lower receiver extension 120 from rotating.

To lengthen the buttstock 10 from the collapsed position, the locking lever 180 is squeezed. While still squeezing the locking lever 180, the buttstock body 190 can be moved in or out. When the buttstock body 190 is at a desired position, the locking lever 180 is released. Releasing the locking lever 180 allows the spring-biased pin 150 to lock into the nearest detent 22. The shoulder rest 28 may be flipped up, if desired.

Figure 5:
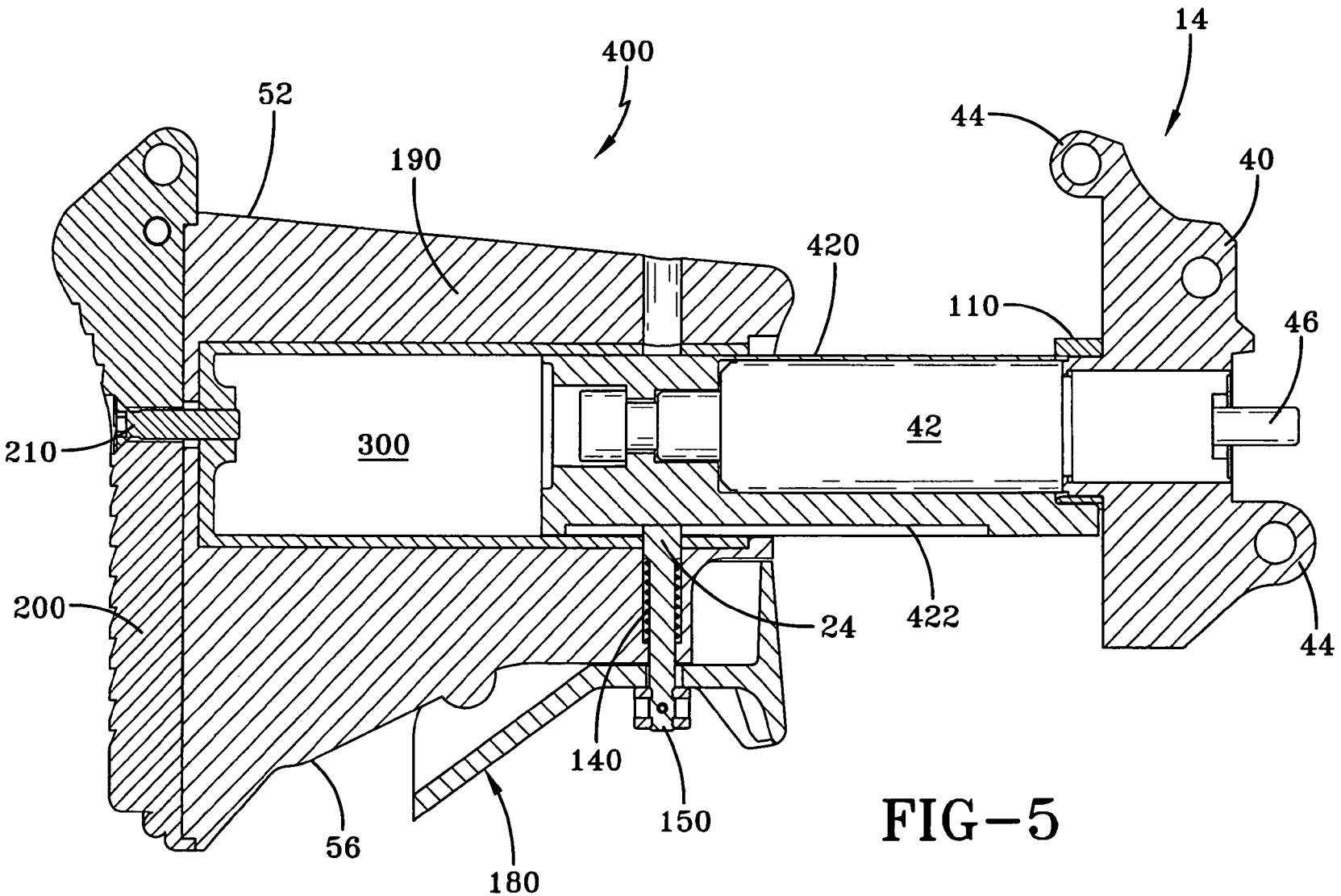
FIG. 5 is a side sectional view of another embodiment of an adjustable, collapsible buttstock.

FIG. 5 is a side sectional view of another embodiment of an adjustable, collapsible buttstock 400. In buttstock 400, friction between the head 24 of the locking pin 150 and the bottom surface 422 of the lower receiver extension 420 provides the locking mechanism (i.e., there are no detents). In this embodiment, the collapsible buttstock 400 is infinitely adjustable along the length of the lower receiver extension 420. As shown in FIG. 5, buttstock 400 is similar to buttstock 10 of FIGS. 2–4, with the exception of the lower receiver extension 420. The bottom surface 422 of lower receiver extension 420 provides a friction surface for engaging pin 150, which acts as a friction clutch. Bottom surface 422 and mating surface of pinhead 24 may be smooth, or provided with irregularities to increase the holding friction. Operation of the buttstock 400 is analogous to operation of the buttstock 10.

To lengthen the buttstock 400 from the collapsed position, the locking lever 180 is squeezed. While still squeezing the locking lever 180, the buttstock body 190 can be moved in or out. When the buttstock body 190 is at a desired position, the locking lever 180 is released. Releasing the locking lever 180 forces the spring biased pin 150 against the bottom surface 422 of the lower receiver extension 420, and locks the buttstock 400 in place. The shoulder rest 28 may be flipped up, if desired. In buttstock 400, the force of compression spring 140 may be increased so that pin 150 is securely locked against surface 422 when the lever 180 is released.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A buttstock for a firearm having a buffer recoil mechanism, the buttstock comprising:

a lower receiver extension having a bore therein that fits over the buffer recoil mechanism, the lower receiver extension being fixed to the buffer recoil mechanism;

a buttstock body including a bore therein for receiving the lower receiver extension, a cheek rest located above the bore in the buttstock body, a generally planar rear surface and a bottom edge, the buttstock body and lower receiver extension being axially movable with respect to each other by movement of the lower receiver extension in the buttstock body bore, the buttstock body including a generally vertical through-hole;

a locking lever disposed along the bottom edge of the buttstock body, the locking lever including a hole therein in alignment with the through-hole in the buttstock body;

a locking pin disposed in the through-hole in the buttstock body and in the hole in the locking lever;

a fastener attached to a bottom of the locking pin; and a compression spring disposed around the locking pin for biasing the locking pin towards the lower receiver extension.

2. The buttstock of claim 1 wherein a bottom portion of the lower receiver extension includes a plurality of detents and the locking pin has a head sized to fit in the plurality of detents in the lower receiver extension.

3. The buttstock of claim 2 wherein a number of the plurality of detents is five.

4. The buttstock of claim 1 wherein the fastener comprises a locking nut and a roll pin.

5. The buttstock of claim 1 further comprising a buttplate attached to the generally planar rear surface of the buttstock body.

6. The buttstock of claim 5 wherein the buttplate comprises a rigid material.

7. The buttstock of claim 5 wherein the buttplate comprises an elastic material.

8. The buttstock of claim 5 further comprising a shoulder rest attached to the buttplate.

9. The buttstock of claim 1 wherein the buffer recoil mechanism comprises a cylindrical portion, the buttstock further comprising a locking collar that engages the cylindrical portion and the lower receiver extension to thereby prevent rotation of the lower receiver extension relative to the buffer recoil mechanism.

10. The buttstock of claim 9 wherein the locking collar includes a pair of flats formed on an interior surface thereof that mate with a pair of flats on an exterior surface of the cylindrical portion.

11. The buttstock of claim 10 wherein the locking collar includes a flat formed on an exterior surface thereof that mate with a flat on the lower receiver extension.

12. The buttstock of claim 1 further comprising a generally hollow insert disposed in the buttstock body.

13. The buttstock of claim 1 wherein the locking lever includes a rounded front surface.

14. A buttstock for a firearm, comprising:

a buffer recoil mechanism having a cylindrical portion;

a lower receiver extension having a bore therein that fits over the cylindrical portion of the buffer recoil mechanism, the lower receiver extension being fixed to the buffer recoil mechanism;

a buttstock body including a bore therein for receiving the lower receiver extension, a cheek rest located above the bore in the buttstock body, a generally planar rear surface and a bottom edge, the buttstock body and lower receiver extension being axially movable with respect to each other by movement of the lower receiver extension in the buttstock body bore, the buttstock body including a generally vertical through-hole;

a locking lever disposed along the bottom edge of the buttstock body, the locking lever including a hole therein in alignment with the through-hole in the buttstock body;

a locking pin disposed in the through-hole in the buttstock body and in the hole in the locking lever;

a fastener attached to a bottom of the locking pin; and a compression spring disposed around the locking pin for biasing the locking pin towards the lower receiver extension.

15. The buttstock of claim 14 wherein a bottom portion of the lower receiver extension includes a plurality of detents and the locking pin has a head sized to fit in the plurality of detents in the lower receiver extension.

16. The buttstock of claim 14 further comprising a buttplate attached to the generally planar rear surface of the buttstock body.

17. The buttstock of claim 14 further comprising a locking collar that engages the cylindrical portion and the lower receiver extension to thereby prevent rotation of the lower receiver extension relative to the buffer recoil mechanism.

18. The buttstock of claim 17 wherein the locking collar includes a pair of flats formed on an interior surface thereof that mate with a pair of flats on an exterior surface of the cylindrical portion.

19. The buttstock of claim 18 wherein the locking collar includes a flat formed on an exterior surface thereof that mates with a flat on the lower receiver extension.

20. The buttstock of claim 14 further comprising a generally hollow insert disposed in the buttstock body.

21. The buttstock of claim 14 wherein the locking lever includes a rounded front surface.

* * * * *